US006912496B1

(12) United States Patent
Bhattacharya et al.

(10) Patent No.: US 6,912,496 B1
(45) Date of Patent: Jun. 28, 2005

(54) PREPROCESSING MODULES FOR QUALITY ENHANCEMENT OF MBE CODERS AND DECODERS FOR SIGNALS HAVING TRANSMISSION PATH CHARACTERISTICS

(75) Inventors: Puranjoy Bhattacharya, Bangalore (IN); Manoj Kumar Singhal, Bangalore (IN); Sangeetha Dummy, Bangalore (IN)

(73) Assignee: Silicon Automation Systems, Bangalore (IN)

( * ) Notice: Subject to any disclaimer, the term of this patent is extended or adjusted under 35 U.S.C. 154(b) by 868 days.

(21) Appl. No.: 09/697,481

(22) Filed: Oct. 26, 2000

Related U.S. Application Data

(60) Provisional application No. 60/161,745, filed on Oct. 26, 1999.

(51) Int. Cl.[7] ..... G10L 21/02
(52) U.S. Cl. ..... 704/228
(58) Field of Search ..... 704/226, 227, 704/228; 381/94.3

(56) References Cited

U.S. PATENT DOCUMENTS

| | | | | | |
|---|---|---|---|---|---|
| 4,283,601 | A | * | 8/1981 | Nakajima et al. | 704/233 |
| 5,353,310 | A | * | 10/1994 | Russell et al. | 375/348 |
| 5,749,065 | A | * | 5/1998 | Nishiguchi et al. | 704/200.1 |
| 5,956,683 | A | * | 9/1999 | Jacobs et al. | 704/270.1 |
| 6,512,789 | B1 | * | 1/2003 | Mirfakhraei | 375/229 |

OTHER PUBLICATIONS

P. Bhattacharya, et al., *An Analysis of the Weaknesses of the MBE Coding Scheme*, Institute of Electrical & Electronics Engineers, Inc. (IEEE), International Conference on Personal Wireless Communications, Jan. 1999; p. 419–422.

Engin Erzin, et al., *Natural Quality Variable–Rate Spectral Speech Coding Below 3.0 KBPS*, Lucent Technologies & Dept. of Electrical & Computer Eng. at Univ. of Cal.

Michele Jamrozik, et al., *Modified Multiband Excitation Model at 2400 BPS*, Electrical & Computer Engineering at Clemson University.

Daniel W. Griffin, et al., *Multiband Excitation Vocoder*, IEEE Transactions on Acoustics, Speech, and Signal Processing, vol. 36, No. 8, Aug., 1988; p. 1223–1235.

Daniel W. Griffin, et al., *Signal Estimation from Modified Short–Time Fourier Transform*, IEEE Transactions on Acoustics, Speech, and Signal Processing, vol. ASSP–32, No. 2, Aug., 1984; p. 236–243.

John C. Hardwick, et al., *The Application of the IMBE Speech Coder to Mobile Communications*, IEEE, Jul. 1991; p. 249–252.

John Makhoul, *Linear Prediction: A Tutorial Review*, Reprinted from Proc. IEEE, vol. 63, No. 4, p. 561–580, Apr., 1975.

Robert J. McAulay, et al., *Computational Efficient Sine–Wave Sythesis and Its Application to Sinusoidal Transform Coding*, IEEE, Sep., 1988; p. 370–373.

Michael R. Portnoff, *Short–Time Fourier Analysis of Sampled Speech*, IEEE Transactions on Acoustics, Speech, and Signal Processing, vol. ASSP–29, No. 3, Jun., 1981; p. 364–373.

* cited by examiner

*Primary Examiner*—Richemond Dorvil
*Assistant Examiner*—Donald L. Storm
(74) *Attorney, Agent, or Firm*—Welsh & Katz, Ltd.

(57) ABSTRACT

Pursuant to one aspect of the invention, a prefilter module that incorporates an inverse filter is used in conjunction with an encoder. The inverse filter has an inverse frequency response of a frequency response of a filter that simulates speech having transmission path characteristics, such as telephone-channel bandwidth speech, and/or noisy speech. The inverse filter is used to compensate transmission path characteristics of an input signal. The inverse filter can be designed using several methods, such as, for example, an autoregressive model or a moving average model. Pursuant to a second aspect of the invention, a parameter preprocessor is used in conjunction with a decoder. The parameter preprocessor performs pitch rectification through use of a medium and linear filter, and updates spectral amplitudes and voicing parameter depending on the pitch rectification. The inverse filter and parameter preprocessor, used in conjunction with an encoder and decoder, respectively, improve signal processing and parameter estimation.

23 Claims, 8 Drawing Sheets

PREPROCESSING MODULES FOR QUALITY ENHANCEMENT OF MBE CODERS AND DECODERS FOR SIGNALS HAVING TRANSMISSION PATH CHARACTERISTICS

CROSS REFERENCE TO RELATED APPLICATION

This application claims the benefit of U.S. Provisional Application No. 60/161,745, filed Oct. 26, 1999.

FIELD OF THE INVENTION

The invention relates to processing a speech signal. In particular, the invention relates to enhancing speech signal quality.

BACKGROUND OF THE INVENTION

There has been a substantial amount of effort in developing toll-quality speech coders that operate below 4 kbps. Most of the coders in this bit-range are parametric in nature; One of the most prominent among these is the Multiband Excitation (MBE) Coder developed by Griffin and Lim. The MBE scheme is derived from mainstream sinusoidal coding (McAulay et al.), where voiced speech is reproduced as a weighted sum of sine waves at the harmonics of a pitch frequency and unvoiced speech bands are reproduced as bandlimited white noise with appropriate amplitudes. The encoding is performed by splitting the input speech into frequency bands centered around the harmonics, and recording the respective spectral amplitudes based on the outcome of corresponding voicing decisions (assuming the excitation is a sinusoid or narrowband noise for the voiced and unvoiced cases, respectively).

The MBE coding scheme has the potential to produce high quality (in terms of intelligibility and naturalness) output speech (Tian et al.) at very low bit rates. The parameters used in the MBE coding scheme are also resistant to moderate levels of noise (15 dB wideband white noise). There are, however, some undesirable characteristics of the scheme that severely hamper the deployment of MBE-based codecs for the purpose of coding speech produced in noisy ambient conditions (above 10 dB wideband noise) and/or speech received via transmission paths, such as a telephone channel.

Under transmission path conditions, and in particular, under telephone-channel-bandwidth (TCB) conditions, the baseband frequencies are grossly attenuated, as shown in FIG. 3. This frequently results in the loss of a pitch component and the components first one or two harmonics for low-pitched speakers, a phenomenon which greatly hampers pitch detection. Pitch detection also becomes increasingly faulty above 15 dB wideband (ambient) noise in the input speech signal. However, all parameter estimates in the MBE scheme are, in one way or the other, derived via a spectral matching mechanism which in turn crucially depends on the harmonic structure created using the pitch parameter. The pitch parameter, therefore is the pivotal element in the parameter estimation scheme and, consequently, errors in pitch detection frequently lead to the corruption of other parameters. As a result, the MBE codec decoded output is prone to several audible distortions such as voice-breaks, screeches, clicks, varying levels of hoarseness, and occasional synthetic tonality, for speech having transmission path characteristics, such as TCB and/or noisy input speech.

It has been confirmed, through repeated tests for speech decoded from TCB inputs, that voice-breaks observed are frequently associated with pitch region (period) halving, while hoarseness is associated with undervoicing. These problems are dominant for low-pitched speakers. Tonality, on the other hand, results from overvoicing.

One spectral amplitude quantization technique involves intermediate spectral smoothing (e.g. if LPC is used, as suggested by Kondoz, a screeching effect is produced for pitch doublings, although such occurrences are relatively infrequent).

The robustness problems discussed above have greatly limited the deployment of MBE coders in real-life situations, except for mobile communications, which have significantly lower quality demands. In a broad sense, these problems have deterred the achievement of toll-quality speech (implying indistinguishable from telephone speech quality) for MBE coders.

This is unfortunate since MBE coders, which have high compression ratios, may be used in a number of applications (primarily storage applications) that are strapped for memory resources. The MBE coders provide twice, and in some cases three times the speech storage capacity over conventional CELP coders.

CELP coders imply waveform coding (as opposed to spectral coding in MBE), and degrade miserably when operating at rates below 5 kbps. For clean 4 kHz bandwidth speech (i.e. sampled at 8 kHz, but not subject to the exact telephone-channel frequency response), MBE codecs deliver virtually the same output quality, at 2–3 kbps, as higher bit rate (5–6 kbps) CELP codecs. However, because of the earlier cited MBE coder problems, the latter continue to be preferred for use in voice communication and storage applications that assume noise and transmission path characteristics, such as telephone channel bandwidth conditions (CELP codecs degrade gracefully under either condition), under normal operating conditions.

Quality degradation in MBE codecs for noisy and transmission path speech, such as telephone-channel speech, has been persistent since its advent. A root cause analysis of the reasons for the distortions induced under the above-mentioned conditions were presented by Bhattacharya et al. in 1999, but researchers have been aware of the existence of the problems for a long time.

Researchers, thus far, have attempted to provide robustness to MBE coders by changing the basic MBE codec modules. They have essentially suggested alternative methods for the robust estimation of pitch and voicing parameters.

These alternate attempts to compensate for transmission path characteristics, such as telephone-channel characteristics, by inverse filtering and to compensate for noise in the input signal by spectral subtraction have not been popular mainly because of the associated implementation problems. In the former case, designing a stable inverse filter for the telephone channel becomes an insurmountable problem when conventional design methods are applied. This is because the telephone channel inverse characteristic involves a major gently sloping segment accompanied by sharp peaks at either end, and deviation from the expected curve becomes audible at virtually all frequencies. In the latter case, the noise compensation process breeds a tonal noise called musical noise, which appears at the decoded output as an unacceptable distortion.

Previous solutions to the projected problem have only been marginally effective because the basic speech signal is often highly corrupted and because the basic speech signal produces a spurious signal with parameter values lying within expected bounds. A common example, in this regard, is where a multiple of the pitch frequency becomes the dominant lowest harmonic and suppresses the actual fundamental frequency under telephone-channel bandwidth conditions. The amount of parametric corruption varies within wide limits (e.g. depending on the loudness and type of noise) further complicating the robust-estimation process.

In addition, one should note that there have not been any estimation processes that have been 100% reliable even under absolutely clean input speech conditions. The pitch estimation accuracy of the invention, when used with the MBE model, decreases gracefully from a 0.2% coarse error rate at 30 dB ambient (white) noise to a 5% coarse error rate at 10 dB ambient noise.

Publications relevant to processing signals representing speech include: McAulay et al., "Mid-Rate Coding based on a sinusoidal representation of speech", Proc. ICASSP85, pp. 945–948, Tampa, Fla., Mar. 26–29, 1985 (discusses the sinusoidal transform speech coder); Griffin, "Multi-band Excitation Vocoder", Ph.D. Thesis, M.I.T, 1987, (Discusses the Multi-Band Excitation (MBE) speech model and an 8000 kbps MBE speech coder); SM. Thesis, M.I.T, May 1988, (discusses a 4800 bps Multi-Band Excitation speech coder); McAulay et al., "Computationally efficient Sine-Wave Synthesis and its applications to Sinusoidal Transform coding", Proc. ICASSP 88, New York, N.Y., pp. 370–373, April 1988, (discusses frequency domain voiced synthesis); D. W. Griffin, J. S. Lim, "Multi-band Excitation Vocoder," IEEE Trans. Acoust., Speech, Signal Processing, vol. 36, pp. 1223–1235, August 1988; P. Bhattacharya, M. Singhal and Sangeetha, "An analysis of the weaknesses of the MBE coding scheme," IEEE international conf. on personal wireless communications, 1999; Tian Wang, Kun Tang, Chonxgi Feng "A high quality MBE-LPC-FE Speech coder at 2.4 kbps and 1.2 kbps, Dept. of Electronic Engineering, Tsinghua University, Beijing, 100084, P. R. Chinna; Engin Erzin, Arun kumar and Allen Gersho "Natural quality variable-rate spectral speech coding below 3.0 kbps, Dept. of Electrical and Computer Eng., University of California, Santa Barbara, Calif., 93106 USA; INMARSAT M voice codec, Digital voice systems Inc. 1991, version 3.0 August 1991; A. M. Kondoz, Digital speech coding for low bit rate communication systems, John Wiley and Sons; Telecommunications Industry Association (TIA) "APCO project 25 Vocoder description" Version 1.3, Jul. 15, 1993, IS102BABA (discusses 7.2 kbps IMBE speech coder for APCO project 25 standard); Telephone transmission quality transmission standards, ITU Recommendation p. 48; U.S. Pat. No. 5,081,681 (discloses MBE random phase synthesis); Jayant et al., Digital Coding of Waveforms, Prentice-Hall, 1984, (discussing the speech coding in general); U.S. Pat. No. 4,885,790 (discloses sinusoidal processing method); Makhoul, "A mixed-source model for speech compression and synthesis", IEEE (1978), pp. 163–166 ICASS P78; Griffin et al. "Signal estimation from modified short-time fourier transform", IEEE transactions on Acoustics, speech and signal processing, vol. ASSP-32, No. 2, April 1984, pp. 236–243; Hardwick, "A 4.8 kbps multi-band excitation speech coder", S. M. Thesis, M.I.T., May 1988; Almeida et al., "Harmonic coding: A low bit rate, good quality speech coding technique," IEEE (CH 1746-7/82/000 1684) pp. 1664–1667 (1982); Digital voice systems, Inc. "The DVSI IMBE speech compression system," advertising brochure (May 12, 1993); Hardwick et al., "The application of the IMBE speech coder to Mobile communications," IEEE (1991), pp. 249–252 ICASSP 91 May 1991; Portnoff, "Short-time fourier analysis of samples speech", IEEE transactions on accoustics, speech and signal processing, vol. ASSP-29, No-3, June 1981, pp. 324–333; Akaike H., "Power spectrum estimation through auto-regressive model fitting," Ann. Inst. Statist. Math., Vol. 21, pp. 407–419, 1969; Anderson, T. W., "The statistical analysis of time series," Wiley, 1971; Durbin, J., "The fitting of time-series models," Rev. Inst. Int. Statist., Vol. 28, pp. 233–243, 1960; Makhoul J., "Linear Prediction: a tutorial review," Proc. IEEE, Vol. 63, pp. 561–580, April 1975; Kay S. M., "Modern spectral estimation: theory and application," Prentice Hall, 1988; Mohanty M., "Random signals estimation and identification," Van Nostrand Reinhold, 1986. The content of the publications listed above are incorporated herein by reference.

BRIEF SUMMARY OF THE INVENTION

The invention enhances MBE coder performance so that speech having transmission path characteristics, such as telephone-channel bandwidth (TCB) and/or noisy speech input, will have close to toll-quality speech quality. Pursuant to first and second aspects of the invention, separate prefilter and parameter preprocessor modules can be used with an MBE encoder and an MBE decoder, respectively.

Pursuant to a first aspect of the invention, the prefilter module incorporates an inverse filter. The effect of the inverse filter compensates for a transmission path transfer function, such as a telephone channel transfer function but does not compensate for distortions caused by ambient noise. The frequency domain for a telephone-channel inverse filter comprises a smooth middle portion with sudden peakiness at extremities, allowing efficient modeling through an all-pole filter. A transfer function of the inverse filter should conform with a target characteristic over the entire frequency range (this is in contrast to pass band and stop band conventional filters, which have associated gains). The inverse filter can assume the shape of an effective all-pole filter and can be of low order, such as, for example, 6 poles. Hence, it is computationally efficient.

An inverse filter design procedure also ensures that the filter is stable and extremely close to desired characteristics. The inverse filter design procedure is general and may be used under similar design constraints (i.e. to realize spectra that are peaky or have sudden deep valleys). In this case, the inverse characteristic having peaks is used to design an all-pole filter whose coefficients are used for an FIR realization of the target spectral characteristic.

In traditional parametric encoding, it is assumed that corrupted parameters are not subject to further improvement. Further, parametric correlation among a series of adjacent frames is usually not utilized. Consequently, rectifying encoded parameters for a parametric encoder using evolution trajectory information is novel.

A parameter preprocessor (PP) pursuant to a second aspect of the invention is a module that attempts to rectify erroneous estimates of encoded parameters by taking their respective evolution trajectories over a succession of frames into account. This module, therefore, effectively restores decoded speech quality irrespective of the origin of distortion at the encoder input. The parameter preprocessor further assumes simultaneous availability of parameters over a sequence of frames, which is common for storage applications.

The pitch parameter has been identified as the principal indicator of parametric corruption at the individual frame level for the MBE coder. Also, since each parameter has been found to exhibit characteristic trajectory traits, differing methods have been derived to rectify each kind of parameter.

BRIEF DESCRIPTION OF THE DRAWINGS

Further objects of the invention, taken together with additional features contributing thereto and advantages occurring therefrom, will be apparent from the following description of the invention when read in conjunction with the accompanying drawings, wherein.

DETAILED DESCRIPTION OF THE INVENTION

Figure 1:
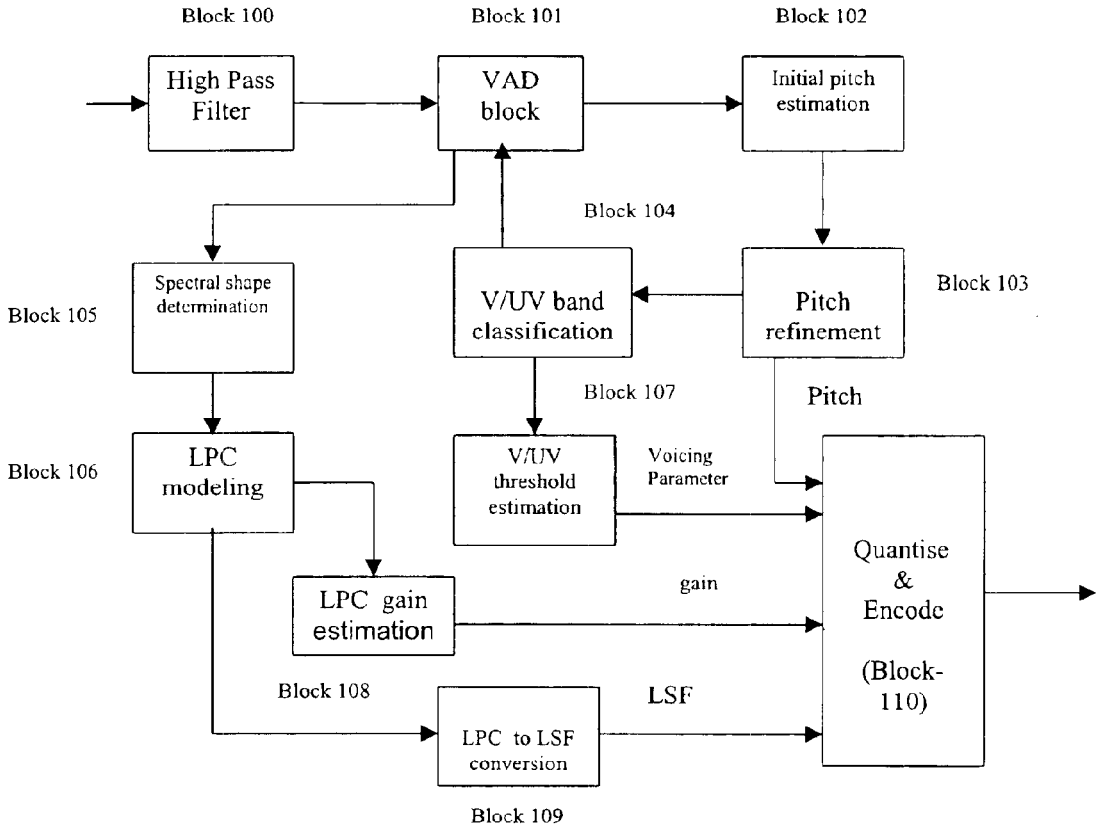
FIG. 1 depicts a block diagram of a Multiband Excitation encoder that may be used in conjunction with the invention.

While the invention is susceptible to use in various forms and embodiments, there is shown in the drawings and will hereinafter be described a specific form and embodiment with the understanding that the disclosure is to be considered an exemplification of the invention and is not intended to limit the invention to the specific form or embodiment illustrated.

A block diagram of one MBE encoder that can be used in conjunction with the invention is shown in FIG. 1 (other encoders not shown may also be used in conjunction with the invention).

The encoder of FIG. 1 involves analysis of input speech, parameterization of features and quantization of parameters. In the analysis stage of the shown encoder, the input speech is passed through block 100 to high-pass filter the signal to improve pitch detection, for situations where samples are received through a telephone channel. The output of block 100 is passed to a voice activity detection module, block 101. This block performs a first level active speech classification, classifying frames as voiced and voiceless. The frames classified voiced by block 101 are sent to block 102 for coarse pitch estimation. The voiceless frames are passed directly to block 105 for spectral amplitude estimation.

During coarse pitch estimation (block 102) of the encoder shown in FIG. 1, a synthetic speech spectrum is generated for each pitch period at half sample accuracy, and the synthetic spectrum is then compared with the original spectrum. Based on the closeness of the match, an appropriate pitch period is selected. The selected coarse pitch is further refined to quarter sample accuracy in block 103 by following a procedure similar to the one used in coarse pitch estimation. However, during quarter sample refinement, the deviation is measured only for higher frequencies and only for pitch candidates around the coarse pitch.

In the encoder of FIG. 1, based on the pitch estimated in block 103, the current spectrum is divided into bands and a voiced/unvoiced decision is made for each band of harmonics in block 104 (a single band comprises three harmonics). For each band, a spectrum is synthesized first assuming all the harmonics in the band are voiced and then assuming all the harmonics in the band are unvoiced. An error for each synthesized spectra is obtained by comparing the respective synthesized spectrum with the original spectrum over each band. If the voiced error is less than the unvoiced error, the band is marked voiced, otherwise it is marked unvoiced.

In the encoder of FIG. 1, a Voicing Parameter (VP) is introduced to reduce the number of bits required to transmit the voicing decisions found in block 104. The VP denotes the band threshold, under which all bands are declared unvoiced and above which all bands are marked voiced. Instead of a set of decisions, a single VP is calculated in block 107.

Speech spectral amplitudes are estimated by generating a synthetic speech spectrum and comparing it with the original spectrum over a frame. The synthetic speech spectrum of a frame is generated so that distortion between the synthetic spectrum and the original spectrum is minimized in a sub-optimal manner in block 105.

Spectral magnitudes are computed differently for voiced and unvoiced harmonics. Unvoiced harmonics are represented by the root mean square value of speech in each unvoiced harmonic frequency region. Voiced harmonics, on the other hand, are represented by synthetic harmonic amplitudes, which characterize the original spectral envelope for voiced speech.

The spectral envelope contains magnitudes of each harmonic present in the frame. Encoding these amplitudes require a large number of bits. Because the number of harmonics depends on the fundamental frequency, the number of spectral amplitudes varies from frame to frame. Consequently, in the encoder of FIG. 1, the spectrum is quantized assuming it is independent of fundamental frequency, and modeled using a linear prediction technique in blocks 106 and 108. This helps reduce the number of bits required to represent the spectral amplitudes. LP coefficients are then mapped to corresponding Line Spectral Pairs (LSP) in block 109, which are then quantized using multi-stage vector quantization. The residual of each stage is quantized in a subsequent stage in block 110.

Figure 2:
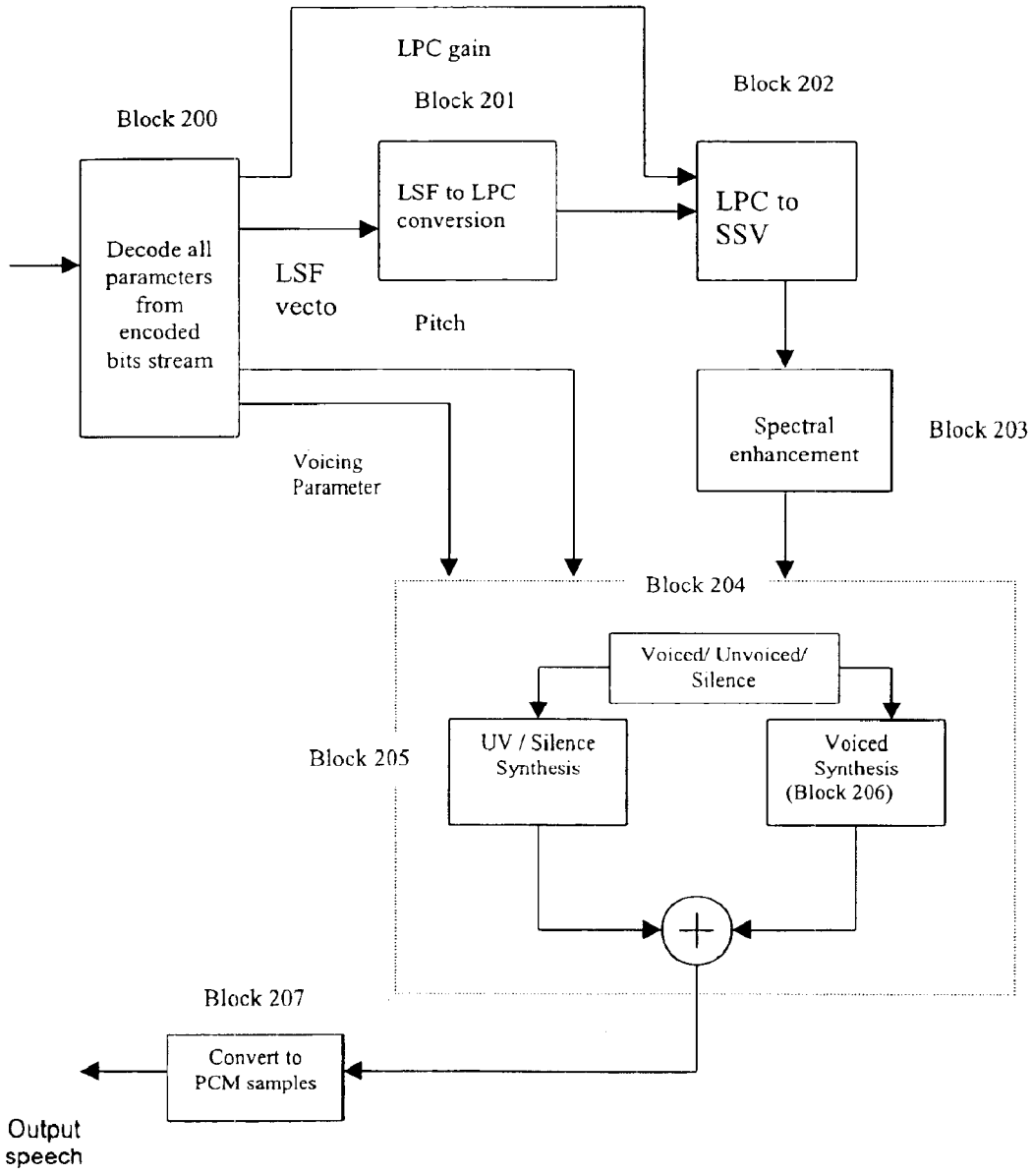
FIG. 2 depicts a block diagram of a Multiband Excitation decoder that may be used in conjunction with the invention.

A block diagram of an MBE decoder that may be used with the invention is illustrated in FIG. 2 (other decoders not shown may also be used in conjunction with the invention).

Parameters from the encoder are first decoded in block 200. A synthetic speech spectrum is then reconstructed using decoded parameters, including fundamental frequency values, spectral envelope information and voiced/unvoiced characteristics of the harmonics. Speech synthesis is performed differently for voiced and unvoiced components and consequently depends on the voiced/unvoiced decision of each band. Voiced portions are synthesized in the time domain whereas unvoiced portions are synthesized in the frequency domain.

In the decoder of FIG. 2, the spectral shape vector (SSV) is determined by performing a LSF to LPC conversion in block 201. Then using the LPC gain and LPC values computed during the LSF to LPC conversion (block 201), a SSV is computed in block 202. The SSV is spectrally enhanced in block 203 and inputted into block 204. The pitch and VP from the decoded stream are also inputted into block 204. In block 204, based on the voiced/unvoiced decision, a voiced or unvoiced synthesis is carried out in blocks 206 or 205, respectively.

An unvoiced component of speech is generated from harmonics that are declared unvoiced. Spectral magnitudes of these harmonics are each allotted a random phase generated by using a random phase generator to form a modified noise spectrum. The inverse transform of the modified spectrum corresponds to an unvoiced part of the speech.

Voiced speech represented by individual harmonics in the frequency domain is synthesized using sinusoidal waves. The sinusoidal waves are defined by their amplitude, frequency and phase, which were assigned to each harmonic in the voiced region.

The phase information of the harmonics is not conveyed to the decoder. Therefore, in the decoder of FIG. 2, at transitions from an unvoiced to a voiced frame, a fixed set of initial phases having a set pattern is used. Continuity of the phases is then maintained over the frames. In order to prevent discontinuities at edges of the frame, due to variations in the parameters of adjacent frames, both the current and previous frame's parameters are considered. This ensures smooth transitions at boundaries. The two components are then finally combined to produce a complete speech signal by conversion into PCM samples in block 207.

Pursuant to first and second aspects of the invention, separate prefilter and parameter preprocessor modules are used with an encoder, such as, for example, the MBE encoder depicted in FIG. 1, and a decoder, such as, for example, the MBE decoder depicted in FIG. 2, respectively. As a result, on one hand, the modules do not preclude further developments to the MBE coder structure, and on the other, the modules may be strapped onto various implementations of the MBE coder, including hardware implementations.

Two modules may be used, one for preprocessing the input signal before it enters the encoding process (FIG. 1), and the other for preprocessing encoded parameters before they are processed by the decoder (FIG. 2). These modules will be referred to as the prefilter and parameter preprocessor (PP) modules respectively. Either of these can operate in isolation of the actual MBE codec modules. Consequently, an improvement to the basic MBE models necessarily accrue to the augmented configuration.

Figure 4:
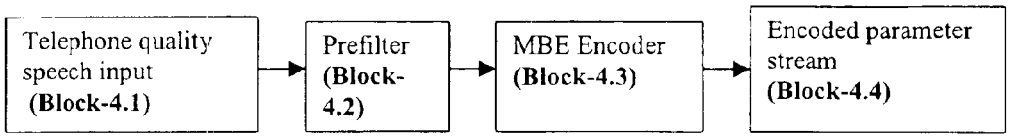
FIG. 4 depicts a block diagram of a prefilter module acting in conjunction with an MBE encoder, pursuant to a first aspect of the invention.

FIG. 4 shows a block-level signal flow through a prefilter module and MBE encoder, pursuant to a first aspect of the invention. The input signal (Block-4.1) is processed by the prefilter module (Block-4.2) to produce a transmission path compensated signal, and in particular, a telephone-channel-compensated signal. The compensated signal is encoded by a MBE encoder (Block-4.3) to produce the encoded parameter stream (Block-4.4).

Figure 5:
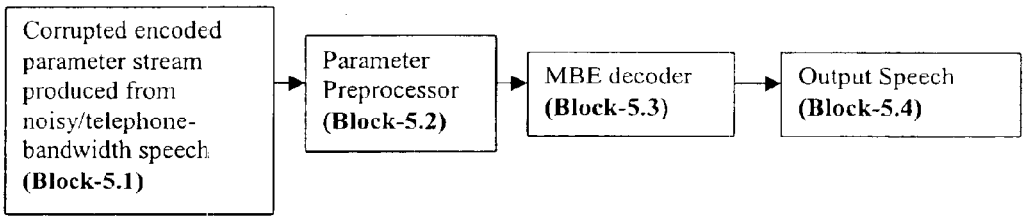
FIG. 5 depicts a block diagram of a parameter preprocessor module acting in conjunction with an MBE decoder, pursuant to a second aspect of the invention.

FIG. 5 shows a block-level signal flow through a parameter pre-processor and MBE decoder, pursuant to a second aspect of the invention. The input encoded parameter stream (Block-5.1) is processed by the parameter preprocessor module (Block-5.2) to produce an error-corrected parameter stream, which is subsequently decoded by a MBE decoder (Block-5.3) to produce output speech (Block-5.4).

Pursuant to a first aspect of the invention, the prefilter module used in conjunction with an MBE encoder incorporates an inverse filter. The inverse filter can be designed to preprocess input speech that has transmission path characteristics, such as TCB speech, by restoring the 60–200 Hz band eliminated during transmission through telephone channels. One type of inverse filter pursuant to a first aspect of the invention comprises an all-pole filter that can be strapped on to the input stage of a MBE speech encoder.

Figure 3:
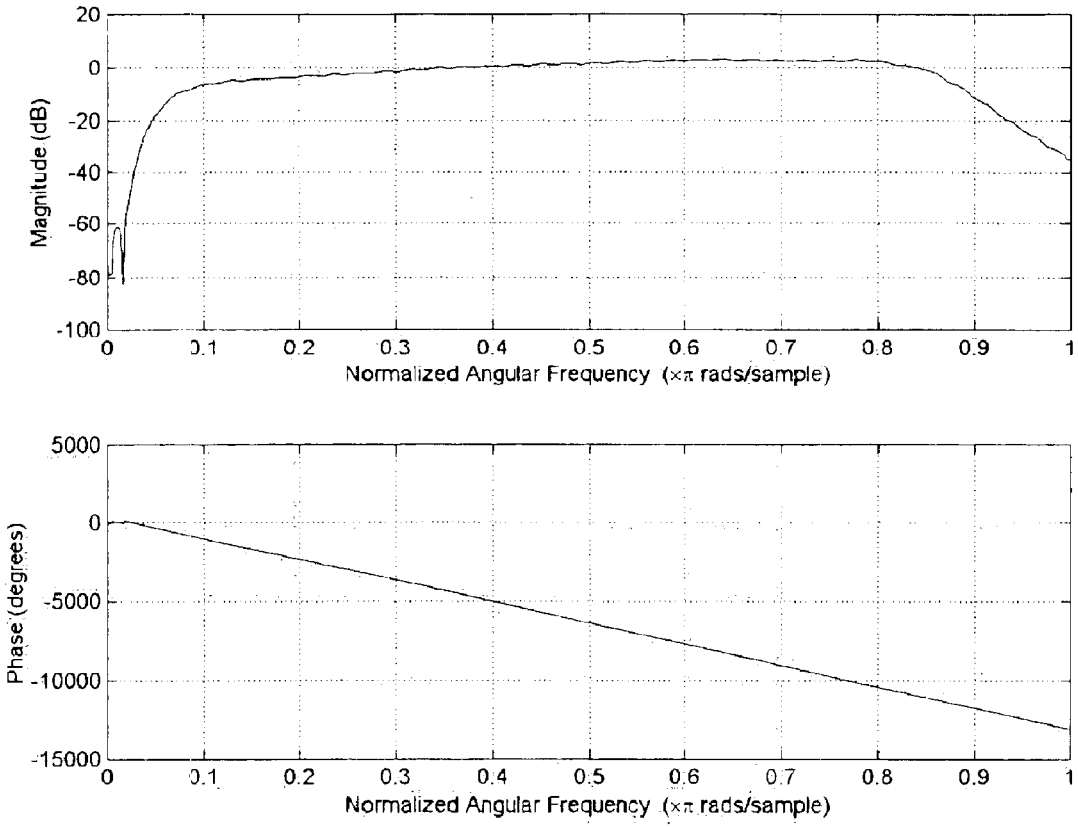
FIG. 3 depicts the amplitude and frequency characteristics of an IRS filter that models spectral characteristics of a telephone channel and that complies with ITU-R (P. 48) specifications.

The inverse filter may be characterized as having an inverse amplitude characteristic of the amplitude characteristics of an IRS filter (details in ITU-R P. 48, shown in FIG. 3) or other filters that approximate frequency-amplitude characteristics of a transmission channel. The IRS filter approximates frequency-amplitude characteristics of a telephone channel. In other words, if the IRS filter has a frequency response $H(\omega)$ and the inverse filter has a frequency response $G(\omega)$, then $G(w)$ should be characterized by the following relation:

$$G(\omega) = \frac{1}{|H(\omega)|} \tag{1}$$

The desired inverse characteristic of the filter has extremely sharp transitions around 200 Hz and 3300 Hz, further, the intermediate region has a variable slope. As a result, FIR or IIR filters designed by available procedures are lacking.

It should be noted that an all-pole filter is well suited in the context of an inverse filter because of an all pole filter's capability to fit peaky spectral characteristics, and therefore an inverse filter solution within this restricted class of IIR filters is beneficial. An inverse filter, illustrated below, is one example of such an all-pole filter. One method to design the illustrated inverse filter using spectral estimation theory is described below.

In this disclosure, the IRS filter is described by the function $h(t)$ in the time domain and the illustrated inverse filter is described by the function $g(t)$ where $H(\omega)$ is the Fourier transform of $h(t)$ and $G(\omega)$ is the Fourier transform of $g(t)$. The objective is to design the illustrated inverse filter so that $$G(\omega) \approx \frac{1}{|H(\omega)|} \tag{2}$$

One method of meeting the objective is to represent a random signal with a power spectral density (PSD) equal to $|G(\omega)|^2$ using an auto-regressive (AR) model. An AR model that comprises an all-pole system excited by white noise $e(n)$, as shown in Block 6.1 of FIG. 6, can be used to represent $|G(\omega)|^2$.

Figure 6:
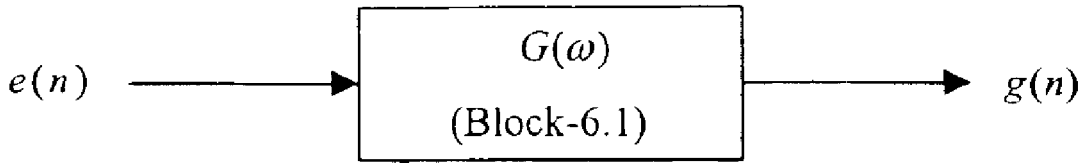
FIG. 6 depicts a block diagram of an autoregressive model used to model an inverse filter, pursuant to a first aspect of the invention.

The output sequence of FIG. 6 [$g(n)$] may be characterized by the equation:

$$g(n) = -\sum_{k=1}^{p} a_k g(n-k) + e(n) \tag{3}$$

where $e(n)$ is an additive white Gaussian noise sequence. The white noise $e(n)$ has a unit power spectral density by definition and the PSD of the random signal being modeled is equal to the square of the magnitude response of the all-pole filter.

Substituting phase information of the inverse filter by a random sequence $g(n)$ allows the above described transformation. Note that this transformation is possible because a phase characteristic restriction of an inverse filter has not been imposed. In addition, note that the assumed random phase is never explicitly specified or used in the design process.

The power spectral density of G(ω) may be characterized by the equation:

$$|G(\omega)|^2 = \frac{1}{\left|1 + \sum_{k=1}^{p} a_k e^{-j\omega k}\right|^2} \tag{4}$$

The parameters of an AR model (ak) can be obtained from the auto-correlation function (ACF) of the random signal by setting up Yule-Walker equations as follows:

$$\begin{bmatrix} R(0) & R(-1) & \cdots & R(-p) \\ R(1) & R(0) & & \\ \vdots & & \ddots & \vdots \\ R(p) & R(p-1) & \cdots & R(0) \end{bmatrix} \cdot \begin{bmatrix} 1 \\ a_1 \\ a_2 \\ \vdots \\ a_p \end{bmatrix} = \begin{bmatrix} \sigma_p^2 \\ 0 \\ 0 \\ \vdots \\ 0 \end{bmatrix} \tag{5}$$

where R(i)=R(−i), i=1, . . . , p, are the respective ACFs at various lags, and $\sigma_p^2$ is the "minimum mean-squared prediction error" for the AR model, which is also equal to the variance of the assumed input white noise sequence.

The ACF R(m) of the virtual random signal g(n) employed in the above equations can be efficiently estimated as the inverse Fourier transform of its PSD (Wiener-Khintchine Theorem), which, under the given circumstances is equal to the square of the inverse magnitude characteristic. This is characterized by the following equation:

$$R(m) = \sum_{k=0}^{K} \frac{1}{|H(k)|^2} \cdot e^{\frac{j2\pi km}{K}} \tag{6}$$

The Yule-Walker equations can be solved using a variety of methods, including the Levinson-Durbin algorithm which exploits the Toeplitz structure of the leftmost matrix in equation 5. The coefficients ($a_1$, . . . , $a_p$) of equation (5) are solved for and used to determine the illustrated inverse filter, which is one example of a suitable all-pole filter.

Figure 9:
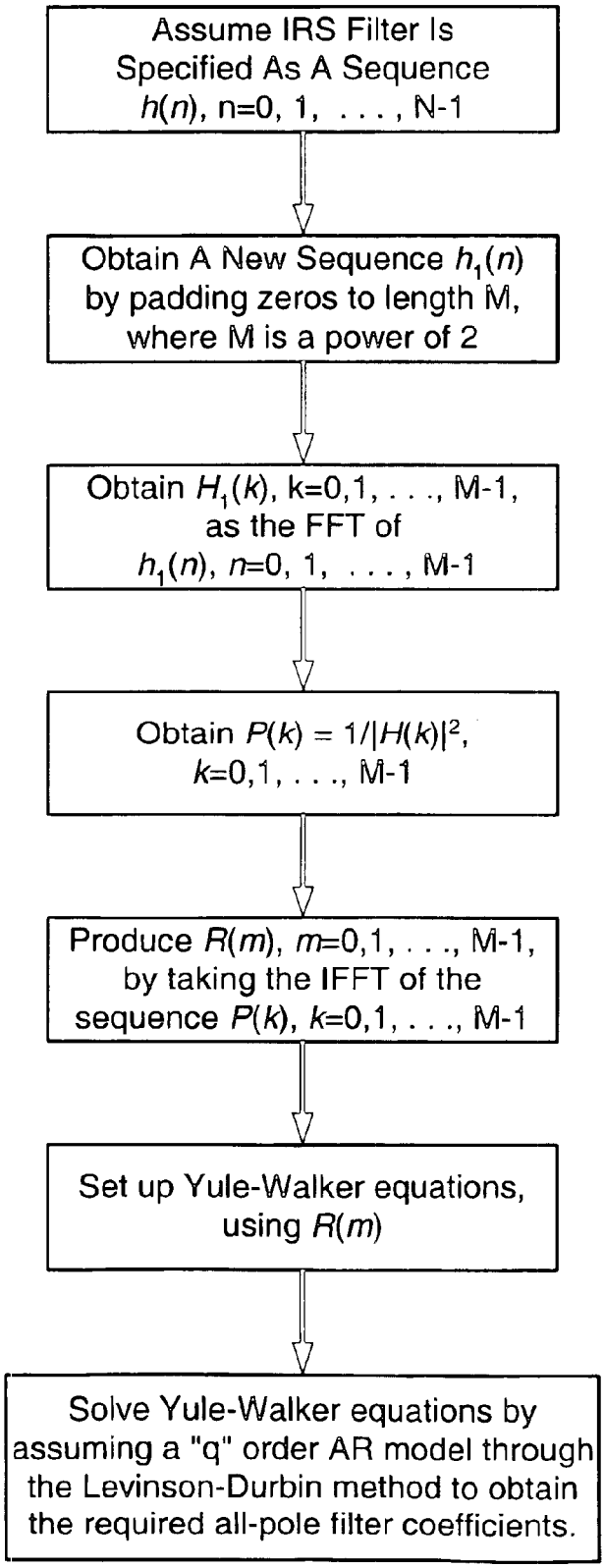
FIG. 9 depicts a flow chart of a method to design an inverse filter according to the invention.

The illustrated inverse filter may be designed using several methods, the following steps illustrated in FIG. 9 describe one method to design the inverse filter.

1. Assume the IRS filter is specified as a sequence h(n), n=0, 1, . . . , N−1.
2. Obtain a new sequence $h_1(n)$ by padding zeroes to make the sequence length equal to the nearest power of 2, say M.
3. Obtain $H_i(k)$, k=0, 1, . . . ,M−1 as the Fast Fourier Transitions of the sequence $h_1(n)$, n=0, 1, . . . , M−1.
4. Obtain $$P(k) = \frac{1}{|H(k)|^2},$$

k=0, 1, . . . M−1.

5. Produce R(m), m=0, 1, . . . ,M-1, by taking the IFFT of the sequence P(k), k=0, 1, . . . , M−1.
6. Set up the Yule-Walker equations, using R(m) computed in step 5, as per equation 5.
7. Solve Yule-Walker equations produced by assuming a "q" order AR model through the Levinson-Durbin method to obtain the required all-pole filter coefficients.

Those of ordinary skill in the art will note that Step 7 merely requires a solution of the Yule-Walker equations, and is amenable to methods other than the Levinson-Durbin method.

Those of ordinary skill in the art will also note that there are several methods to meet the objective of designing the inverse filter. A second method to meet the objective involves modeling $|H(\omega)|^2$ using a Moving Average (MA) model. The MA model parameters are found by solving a set of equations set up using the Inverse Fast Fourier Transform of $|H(\omega)|^2$. These MA model parameters correspond to the numerator polynomial of the direct system, hence they also correspond to the denominator polynomial of the desired inverse characteristic, and hence are the coefficients of the target IIR filter. The MA parameter estimation problem (frequently handled, as mentioned by Kay, through conversion of the MA process into an equivalent AR process), lacks a direct computational solution, reducing the viability of the second method.

In an experiment performed using 15000 frames of telephone-quality test data, the above construct was found to eliminate approximately 80% of the audible artifacts for the MBE codec. The invention has been rigorously tested in lab, using simulated, as well as actual telephone speech data.

In spite of the efficacy of the tested inverse filter, some audible artifacts may persist. Most of these result from erroneous pitch parameter detection as a multiple or sub-multiple of the true pitch parameter value. This is caused by, in certain situations, pitch component attenuation. For example, when pitch components attenuation occurs other harmonics or sub-harmonics may dominate, and these harmonic or sub-harmonics may ultimately be preferred during the matching procedure over the true value. These audible distortions can be eliminated prior to decoding, for applications (primarily storage applications) by parameter preprocessing a parameter stream from the encoder over a succession of frames.

As discussed earlier, the corruption of various parameter estimates for the MBE model is rooted in gross errors in pitch estimation. Pitch parameter corruption, therefore, is used as the primary indicator of parameter corruption over individual frames. The first major step in parameter preprocessing, therefore, is detecting pitch parameter corruption.

The theory behind parameter error detection as well as parameter error correction is based on the gradual variation of most parameters (excluding voicing boundaries) over a sequence of frames. Consequently, the value of a parameter over a frame may be predicted from neighboring parameter values. Pursuant to a second aspect of the invention, the theory of gradual variation of parameters over successive frames is utilized to preprocess signal data.

One example of using the gradual variation involves parameter preprocessing. Parameter preprocessing involves correcting gross pitch errors (primarily doubling and halving errors) using trajectory information and updating other coded parameters accordingly. For example, one method of parameter preprocessing that involves three stages is described below. A first step involves pitch rectification, a second step involves updating spectral amplitudes and a third step involves updating voicing parameters.

The first step of parameter preprocessing in the described method involves pitch rectification. During real-time operation of the encoder, spectral matching schemes concentrate on information contained within the same frame, with minor augmentation using interframe dependencies during tracking. In close temporal proximity to the storage phase (i.e.

preceding or succeeding storage), however, the entire pitch trajectories may be available, and these may be processed using continuity constraints because the pitch parameter changes smoothly over contiguous (voiced) stretches. Two important tools in this regard are: (1) a linear low-pass filter for smoothing, and (2) a median filter. The latter family of filters is efficient for removing sudden departures from the trajectory, while the former smoothes the trajectories. In the described preprocessing method, a long-order median filter may be followed by a smaller-order smoothing filter to remove a large number of pitch halving and doublings, especially ones that occur in smaller chunks (2–3) frames. The filters may be turned off at voiced-region boundaries marked by three or more successively occurring unvoiced frames (a voicing parameter maybe used to derive voicing information).

In the described method, the pitch correction procedure involves predicting pitch value using the linear and median filters described above. The closest multiple or sub-multiple of the actual reported value of P (e.g. 2 P, 3P, P/2, P/3 etc.) to the pitch value of the linear and median filtered pitch trajectory is selected as the corrected pitch valve. In actual implementations, these four derived pitch values are used for comparison, since the possibility of higher multiples and sub-multiples occurring is minimal. Those skilled in the art will recognize, however, that any number of sub-multiples and/or multiples may be used while selecting a corrected pitch value.

Figure 7:
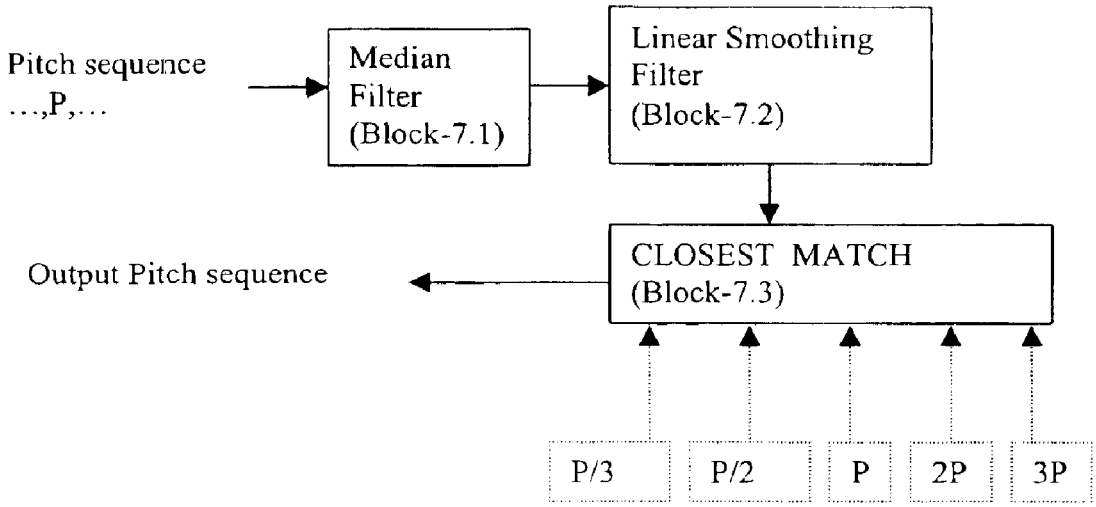
FIG. 7 depicts a block diagram of a pitch rectification procedure used in the parameter preprocessor module that incorporates principles of a second aspect of the invention.

FIG. 7 shows a schematic diagram of the first step (pitch rectification) of the described method. The sequence of pitch values is first median filtered (Block-7.1), and then linearly smoothed (Block-7.2). The resulting value is then matched to various multiples and sub-multiples of the actual reported pitch value (Block-7.3). The closest multiple or sub-multiple match is declared as the corrected pitch value.

As mentioned earlier, mere correction of the pitch value does not automatically rectify other respective artifacts because, apart from leading to the proliferation of fine parametric errors, the entire banding structure is changed (e.g. when a pitch-period halving occurs, there are half as many spectral coefficients recorded). An updating procedure for other parameters, operating over frames with pitch errors, requires band-structure restoration as well as correction of minor errors through trend information.

The second step of parameter preprocessing in the described method involves updating spectral amplitudes. In the second step, all pitch errors (gross ones) are classified into halvings, doublings, triplings etc. If the pitch frequency originally detected was half the corrected value, there will be twice as many harmonics. If a spectrum is reconstructed by deleting odd harmonics, the original spectrum will be restored.

If, on the other hand, the pitch frequency detected originally was twice the corrected value, the alternate harmonics have not been computed (i.e. spectral amplitudes). These can, however, be partially reconstructed, assuming smoothness of the gross spectrum, by log-linear interpolation between alternate harmonics over the same frame.

Similar schemes of spectral amplitude restoration can be employed for other harmonics and sub-harmonics of incorrectly detected pitch frequency. Procedures to modify spectra relating to pitch frequencies that were ½, ⅓, 2 times, or 3 times the corrected pitch value are listed below. Those skilled in the art will recognize that similar procedures may be used to modify other spectra.

For example, if the pitch frequency originally detected was one-half of the corrected pitch value, only 2 kth harmonics (i.e. the second, fourth, sixth, etc. harmonic) should be retained. If the pitch frequency originally detected was one-third of the corrected pitch value, only 3 kth harmonics (i.e. the third, sixth, ninth, etc. harmonic) should be retained. If the pitch frequency originally detected was twice the corrected pitch value one harmonic should be inserted at the (k+½)th harmonic position between successive harmonics (i.e., insert a ½k harmonic between the 0 and $1^{st}$ harmonics, insert a 1½ k harmonic between the $1^{st}$ and $2^{nd}$ harmonics, etc). The amplitude of the inserted (k+½)th harmonic can be characterized by the equation:

$$A(k+\tfrac{1}{2})=\sqrt{A(k)\cdot A(k+1)} \tag{7}$$

If the pitch frequency originally was three times the corrected pitch value, two harmonics should be inserted at (k+⅓)th and (k+⅔)th positions between successive harmonics (i.e., insert a ⅓ k and ⅔ k harmonic between the 0 and $1^{st}$ harmonics, insert a 1⅓ k harmonic and 1⅔ k harmonic between $\mathbf{1}^{st}$ and $2^{nd}$ harmonics, etc). The amplitudes of the inserted (k+⅓)th and (k+⅔)th harmonics can be characterized by the equations:

$$\begin{aligned} A(k+1/3) &= \sqrt[3]{A^2(k)A(k+1)} \\ A(k+2/3) &= \sqrt[3]{A(k)A^2(k+1)} \end{aligned} \tag{8}$$

The third step of parameter preprocessing in the described method involves updating voicing parameters. Trajectories of voicing are characterizable during a single voiced-to-unvoiced transition, and a Voicing Parameter (VP) is assumed for the spectrum of each frame of voiced speech. When the pitch is detected inaccurately, the VP, which is estimated using the same spectral matching scheme as the pitch parameter is estimated with, usually plunges abruptly to a low value. This, apart from certain extreme cases, does not usually cause the entire frame to be detected as unvoiced, therefore preventing circularity in the error correction procedure (note that the pitch correction is based on a frame voicing decision derived from the VP).

Pursuant to the third step of the described method, the VP can be partially restored by obtaining an estimate through smoothing a VP trajectory over a small sequence of frames centered around the erroneously coded frame (characterized by a detected gross pitch error) using median and linear filtering. The filtered value can then be recorded as the corrected VP.

Figure 8:
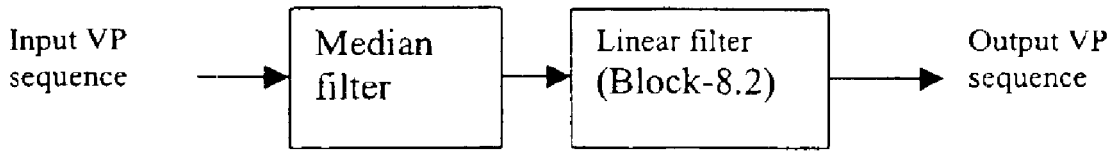
FIG. 8 depicts a block diagram of a voicing parameter correction procedure used in the parameter preprocessor module that incorporates principles of a second aspect of the invention.

FIG. 8 shows a schematic diagram of the third step (voicing parameter updation) of the described method. The input VP sequence is first median filtered (Block-8.1) and subsequently linear filtered (Block 8.2) to generate the output VP sequence.

The described inverse filter and parameter preprocessor were tested using a 15,000 frame test sequence. The test showed that the described inverse filter and parameter preprocessor minimized observable errors of the 15,000 test frame sequence to levels close to non-TCB (clean input speech) levels. In addition, at the expense of a short initial delay, the test showed that the described inverse filter and parameter preprocessor can be applied to real time encode-decode applications.

The described error correction procedures operate under the assumption that parameter trajectories obtained over frame sequences are reflective of the principal variational trends, and that they do not explicitly depend upon the mechanism causing the errors. Therefore, the methods for parameter correction through preprocessing are equally applicable to parameter degradation in TCB conditions and high levels of input ambient noise.

From the foregoing it will be observed that numerous modifications and variations can be effectuated without departing from the true spirit and scope of the invention. It is to be understood that no limitation with respect to the specific use illustrated is intended or should be inferred. The disclosure is intended to cover by the appended claims all such modifications as fall within the scope of the claims.

What is claimed is:

1. A method of signal processing signals having transmission path characteristics, comprising the steps of:

inverse filtering an input signal having transmission path characteristics before processing the input signal wherein the transmission path characteristics of the input signal are reduced; and processing the input signal;

wherein an inverse filter is used to filter the input signal and an encoder is used to process the input signal, the inverse filter being in communication with the encoder;

the inverse filter having an inverse amplitude response of a filter described by h(t), the filter approximating noisy ambient conditions including telephone-channel-bandwidth conditions and the inverse filter response being characterized by:

$$G(\omega) \approx \frac{1}{|H(\omega)|}$$

wherein H(ω) is the frequency response of h(t) and G(ω) is the inverse filter frequency response.

2. The method of claim 1, wherein the encoder is a Multi-Band Excitation (MBE) encoder and the inverse filter produces a frequency response having a smooth middle portion with peakiness at extremities of the frequency response.

3. The method of claim 1, wherein the inverse filter comprises an all pole filter.

4. The method of claim 3 wherein the inverse filter is a low order filter including about six poles.

5. The method of claim 1, wherein a random signal having a power density characterized by $|G(\omega)|^2$ is used to design the inverse filter, wherein the processing step comprises the sub-steps of:

parameterizing the input signal; and encoding the input signal; and the processing the signal method further comprises the steps of:

preprocessing the encoded signal; and decoding the preprocessed encoded signal, wherein a parameter preprocessor is used to preprocess the encoded signal and a decoder is used to decode the preprocessed encoded signal, the encoder being in communication with the parameter preprocessor and the parameter preprocessor being in communication with the decoder.

6. A method for preprocessing a signal having transmission path characteristics, comprising the steps of:

obtaining a first sequence, wherein one of the at least one obtained sequence is a first sequence [h(n)] wherein n=0, 1, . . . N−1, and N−1 is a length value of the first sequence;

obtaining a second sequence $[h_1(n)]$that modifies the first sequence [h(n)], the second sequence having a length M and the M length value being equal to a closest power of 2 after the N−1 length value;

wherein the FFT is taken on the second obtained sequence $[h_1(n)]$ to determine H(k) taking a Fast Fourier Transform (FFT) of the second obtained sequence to determine H(k);

obtaining P(k) by using H(k), wherein P(k) is characterized by:

$$P(k) = \frac{1}{|H(k)|^2},$$

k=0, 1, . . . , M−1;

taking an inverse Fast Fourier Transform (IFFT) of P(k) to obtain R(m), wherein m=0, 1, . . . M−1;

preparing Yule-Walker equations using the obtained R(m) values;

solving the Yule-Walker equations to obtain coefficients;

using the obtained coefficients to design an inverse filter; and preprocessing the signal having transmission path characteristics with the inverse filter.

7. The method of claim 6, wherein the using the obtained coefficients to design the inverse filter comprises the sub-steps of:

using the obtained coefficients to determine G(ω), wherein G(ω) is a frequency response of the inverse filter, and wherein $$G(\omega) \approx \frac{1}{|H(\omega)|},$$

H(ω) being the frequency response of h(t), h(t) being a time domain description of a filter that approximates transmission path characteristics including telephone-channel-bandwidth conditions, and h(n) being a sequence representing the approximating filter;

using G(ω) to determine g(t), wherein g(t) is the time domain description of the inverse filter; and using g(t) to design the inverse filter.

8. The method of claim 7 wherein $|G(\omega)^2$ is characterized by the equation $$|G(\omega)|^2 = \frac{1}{\left|1 + \sum_{k=1}^{p} a_k e^{-j\omega k}\right|^2}$$

wherein $a_k$ are the ρ obtained coefficients $a_1, \ldots, a_\rho$.

9. The method of claim 6, wherein the Yule-Walker equations are characterized by:

$$\begin{bmatrix} R(0) & R(-1) & \cdots & R(-p) \\ R(1) & R(0) & & \\ \vdots & & \ddots & \vdots \\ R(p) & R(p-1) & \cdots & R(0) \end{bmatrix} \cdot \begin{bmatrix} 1 \\ a_1 \\ a_2 \\ \vdots \\ a_p \end{bmatrix} = \begin{bmatrix} \sigma_p^2 \\ 0 \\ 0 \\ \vdots \\ 0 \end{bmatrix}$$

wherein a $\sigma_\rho^2$ is a minimum mean-squared error of an auto recursive model, and $a_1, \ldots, a_\rho$ are the coefficients to be solved for.

10. The method of claim 6 wherein the inverse Fast Fourier TranSform (IFFT) of P(k) is characterised by;

$$IFFT(P(k)) = R(m) = \sum_{k=0}^{M-1} \frac{1}{|H(\omega)|^2} * e^{\frac{j2\pi km}{M-1}}.$$

.

11. The method of claim 6, wherein the Yule Walker equations are solved by assuming a 'q' order Auto Recursive model and using a Levinson-Durbin method.

12. A method of preprocessing a signal having transmission path characteristics, comprising the steps of:

obtaining a frequency response $[H(\omega)]$ of a filter that approximates noisy ambient conditions including telephone-channel-bandwidth conditions;

modeling $|H(\omega)|^2$ using a moving average model comprising the sub-steps of:

taking the inverse Fast Fourier Transform (IFFT) of $|H(\omega)^2$ to formulate a set of equations;

solving the set of equations to obtain moving average model parameters;

using the moving average model parameters to design an inverse filter; and preprocessing the signal having transmission path characteristics with the inverse filter.

13. The method of claim 12 wherein the using the moving average model average model parameters to design the inverse filter comprises the sub-steps of:

applying the parameters to the equation:

$$|G(\omega)|^2 = \frac{1}{\left|1 + \sum_{k=1}^{p} a_k e^{-j\omega k}\right|^2} = \frac{1}{|H(\omega)|^2}$$

wherein $G(\omega)$ is the frequency response of the inverse filter and $a_k$ are the p model parameters $a_1, \ldots, a_p$; and using $G(\omega)$ to design the inverse filter.

14. A method of processing received encoded data, comprising the steps of:

preprocessoring the received encoded data before decoding the data, wherein the preprocessoring the received encoded data step includes the sub-steps of:

obtaining signal data from the received encoded data wherein the obtained data includes pitch parameter data for a trajectory of successive frames of the signal;

removing at least one pitch parameter departure from the trajectory of successive frames;

smoothing the trajectory;

calculating at least one multiple corresponding to an obtained pitch parameter of a frame having a pitch parameter departure and at least one sub-multiple corresponding to the obtained pitch parameter;

comparing a pitch parameter from the removed and smoothened trajectory that corresponds to the obtained pitch parameter with the at least one corresponding multiple and the at least one corresponding sub-multiple; and replacing the obtained pitch parameter with a new pitch parameter based on the comparison, the new pitch parameter being selected from the at least one corresponding multiple and the at least one corresponding sub-multiple; and decoding the data.

15. The method of claim 14 wherein a parameter preprocessor performs the preprocessoring step and a decoder performs the decoding step, the parameter preprocessor being in communication with the decoder.

16. The method of claim 15 wherein the received encoded data is received from an encoder, the encoder being in communication with the parameter preprocessor.

17. The method of claim 14, wherein two multiples are calculated for each obtained pitch parameter of a frame having a pitch departure, two sub-multiples are calculated for each obtained pitch parameter of a frame having a pitch departure, the comparing step is performed for each obtained pitch parameter of a frame having a pitch departure, and the replacing step is performed for each obtained pitch parameter of a frame having a pitch departure.

18. The method of claim 14, wherein a median filter is used to remove departures and a small order linear filter is used to smoothen.

19. The method of claim 18, wherein the obtained data further includes unvoiced frame and voiced frame information, and wherein the median filter and the small order linear filter are turned off when three successive unvoiced frames are detected.

20. The method of claim 14, wherein the obtained data further includes spectral amplitude information; and wherein the preprocessoring the received encoded data step further includes the sub-steps of:

adjusting a number k of harmonics for a spectrum of a frame having a new pitch parameter.

21. The method of claim 20, wherein the adjusting a number of harmonics step includes the sub-steps of:

removing each (2k−1)th harmonic of the spectrum if the new pitch parameter is one-half the value of the obtained pitch parameter;

removing each (3k−1)th harmonic and each (3k−2)th harmonic of the spectrum if the new pitch parameter is one-third the value of the obtained pitch parameter;

inserting one harmonic at each (k+½) location of the spectrum if the new pitch parameter is twice the value of the obtained pitch parameter, each inserted (k+½)th harmonic having an amplitude characterized by the equation $A(k+½)=\sqrt{A(k)*A(k+1)}$; and inserting one harmonic at each (k+⅓) and one harmonic at each (k+⅔) location of the spectrum if the new pitch parameter is three times the value of the obtained pitch parameter, each inserted (k+⅓)th harmonic having an amplitude characterized by the equation $$A(k+1/3) = \sqrt[3]{A^2(k)A(k+1)}$$

and each inserted (k+⅔)th harmonic having an amplitude characterized by the equation $$A(k+2/3) = \sqrt[3]{A(k)A^2(k+1)}.$$

22. The method of claim 20, wherein the obtained data further includes voice parameter information; and wherein the preprocessoring the received data step further includes the sub-steps of:

median filtering a voice parameter trajectory, the voice parameter trajectory including voice parameter information of the frame having a new pitch parameter, voice parameter information of frames preceding the frame having a new pitch parameter, and voice parameter information of frames succeeding the frame having a new pitch parameter;

linear filtering the voice parameter trajectory;

using the median and linear filtered voice parameter trajectory to obtain a new voice parameter trajectory.

23. A speech system comprising:

an inverse filtering means for inverse filtering signal data having transmission path characteristics;

an encoder, the encoder including parameterizing means for parameterizing the signal data and encoding means for encoding the signal data, the encoder being in communication with the inverse filtering means;

a parameter preprocessor, the parameter preprocessor including receiving means for receiving the encoded signal data and preprocessoring means for preprocessoring the received encoded signal data, the preprocessoring means including:

means for obtaining signal data from the received encoded data, wherein the obtained data includes pitch parameter data for a trajectory of successive frames of the signal data;

means for removing at least one pitch parameter departure from the trajectory of successive frames;

means for smoothing the trajectory;

means for calculating at least one multiple corresponding to an obtained pitch parameter of a frame having a pitch parameter departure and at least one sub-multiple corresponding to the obtained pitch parameter;

means for comparing a pitch parameter from the removed and smoothened trajectory that corresponds to the obtained pitch parameter with the at least one corresponding multiple and the at least one corresponding sub-multiple; and means for replacing the obtained pitch parameter with a new pitch parameter based on the comparison, the new pitch parameter being selected from the at least one corresponding multiple and the at least one corresponding sub-multiple the parameter preprocessor being in communication with the encoder;

a decoder, the decoder including decoding means for decoding the preprocessed signal data and synthesizing means for synthesizing the preprocessed signal data into a speech signal, the decoder being in communication with the parameter preprocessor.

* * * * *

UNITED STATES PATENT AND TRADEMARK OFFICE

CERTIFICATE OF CORRECTION

PATENT NO. : 6,912,496 B1
APPLICATION NO. : 09/697481
DATED : June 28, 2005
INVENTOR(S) : Puranjoy Bhattacharya, Manoj Kumar Singhal and Sangeetha It is certified that error appears in the above-identified patent and that said Letters Patent is hereby corrected as shown below:

Title page, item [75]
Inventors,
Change "Sangeetha Dummy" to -- Sangeetha --.

Signed and Sealed this

Fourteenth Day of July, 2009

JOHN DOLL
*Acting Director of the United States Patent and Trademark Office*